US008894499B2

(12) United States Patent
Smythe

(10) Patent No.: US 8,894,499 B2
(45) Date of Patent: Nov. 25, 2014

(54) RIDE

(76) Inventor: Stephen Francis Smythe, Warkworth (NZ)

( * ) Notice: Subject to any disclaimer, the term of this patent is extended or adjusted under 35 U.S.C. 154(b) by 320 days.

(21) Appl. No.: 12/341,026

(22) Filed: Dec. 22, 2008

(65) Prior Publication Data

US 2009/0264211 A1 Oct. 22, 2009

(51) Int. Cl.
*A63G 3/00* (2006.01)
*A63G 21/18* (2006.01)

(52) U.S. Cl.
CPC ..... *A63G 21/18* (2013.01)
USPC ..... 472/117

(58) Field of Classification Search
USPC ..... 472/128
See application file for complete search history.

(56) References Cited

U.S. PATENT DOCUMENTS

| | | | | |
|---|---|---|---|---|
| 4,805,896 | A * | 2/1989 | Moody | 472/117 |
| 5,421,782 | A * | 6/1995 | Lochtefeld | 472/117 |
| 5,766,082 | A * | 6/1998 | Lochtefeld et al. | 472/117 |
| 7,568,859 | B2 * | 8/2009 | McFarland | 405/79 |
| 2006/0026746 | A1 * | 2/2006 | McFarland | 4/491 |

* cited by examiner

*Primary Examiner* — Michael Dennis
(74) *Attorney, Agent, or Firm* — Young & Thompson

(57) ABSTRACT

A ride is formed comprising a channel forming a closed loop. The channel is able to receive water. Wave forming means are provided operable to create a wave, when the channel contains water, such that the wave will progress around the channel. The wave is of sufficient size to enable aquatic pastimes to be performed on the wave.

4 Claims, 8 Drawing Sheets

RIDE

This invention has been devised particularly though not necessarily solely for use in providing a ride in the nature of a wave to provide an opportunity for activities using a wave such as surfing whether using a surfboard or body surfing or using other equipment for such purposes.

DESCRIPTION OF THE RELATED ART

There is a continuing need for aquatic entertainment that can bring both enjoyment and an amount of thrill particularly in a safe, controlled yet stimulating environment.

BRIEF SUMMARY OF THE INVENTION

It is therefore an object of the present invention to provide a ride which will go at least some way towards meeting the foregoing requirements in a simple yet effective manner or which will at least provide the public with a useful choice.

Accordingly in one aspect the invention may broadly be said to consist in a ride comprising a channel forming a closed loop, the channel being able to receive water, wave forming means operable to create a wave, when the channel contains water, such that the wave will progress around the channel, and the wave being of sufficient size to enable aquatic pastimes to be performed on the wave.

Preferably the characteristics of the wave can be varied.

Preferably the wave forming means is operable to increment the wave from time to time.

Preferably the wave forming means increments the wave as the wave passes a selected point.

Preferably the wave forming means operates in a branch channel.

Preferably the wave forming means can generate waves sequentially to allow several waves to travel about the channel at any one time.

Preferably the branch channel is tangential to the channel forming a closed loop. Preferably the channel includes both left and right hand turns.

Preferably the channel includes optional sections that are temporarily blocked off to the main channel at each of their ends. These sections can be included in the main channel circuit by removing from each of their ends smooth barriers which may then be used to block off the section of channel formerly in use.

Preferably the channel can have an island which smoothly separates the wave in to two distinct parts allowing these two parts to join together as they pass beyond the island.

Preferably the channel is formed by a trench and/or an embankment in or on the ground or both.

Alternatively the channel is formed by a membrane carrying floats that are adjacent the edge of the membrane.

In a further aspect the invention may broadly be said to consist in a wave path for water wherein a wave travels about a closed loop.

Preferably the wave height is intermittently increased as the wave moves about the wave path.

BRIEF DESCRIPTION OF THE DRAWINGS

This invention may also broadly be said to consist in the parts, elements and features referred to or indicated in the specification of the application, individually or collectively, and any or all collectively of any two or more of the parts, elements or features, and where specific integers are mentioned herein which have known equivalents such equivalents are deemed to be incorporated herein as if individually set forth.

One preferred form of the invention will now be described with reference to the accompanying drawings in which.

DETAILED DESCRIPTION OF THE PREFERRED EMBODIMENTS

Figure 1:
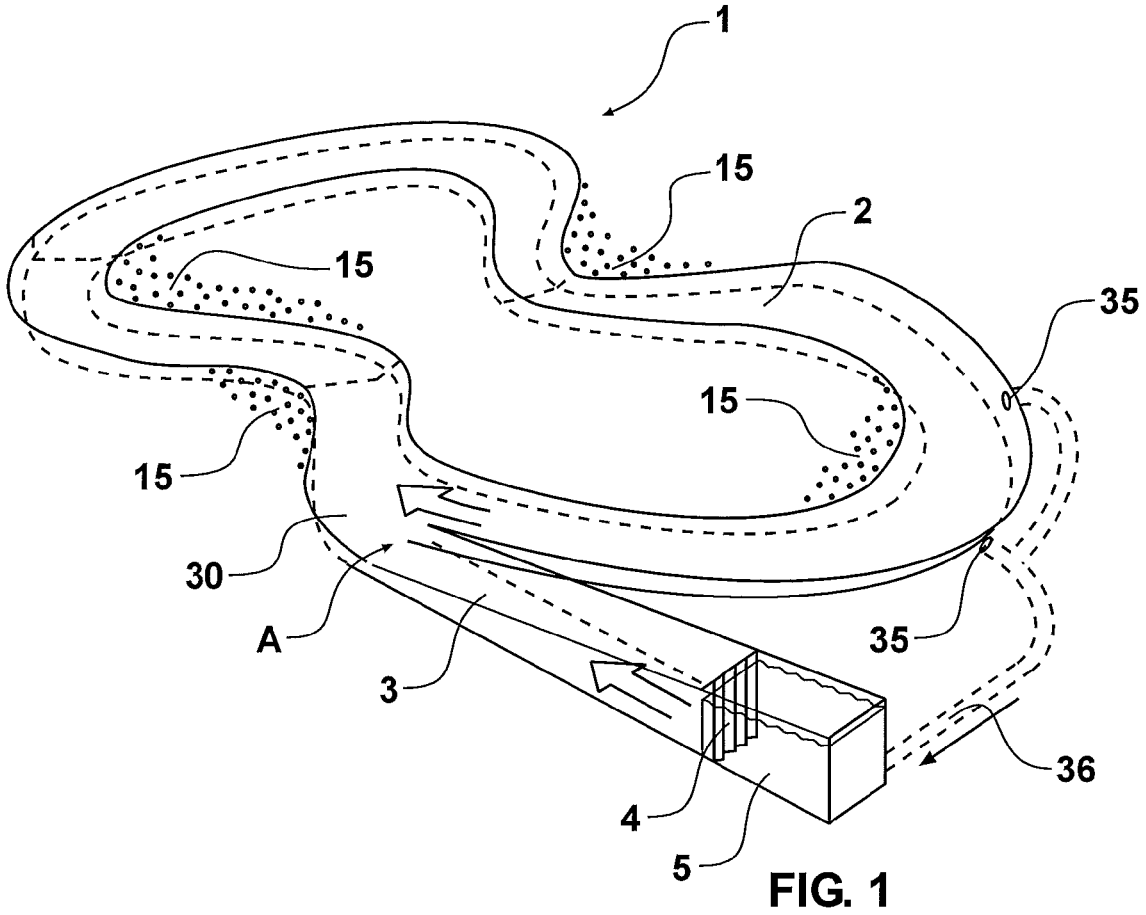
FIG. 1 is a diagrammatic perspective view of a ride according to a preferred form of the invention.

Referring to FIG. 1 the ride 1 comprises an elongate channel 2 in the form of a closed loop. In the construction of FIG. 1 the closed loop is somewhat in the form of an hour glass and includes both left hand and right hand turns.

The channel 2 is able to be filled with water and a wave forming apparatus is provided which causes a wave to pass around the channel 2 when the channel contains water. Preferably the wave forming apparatus operates in a branch channel 3 which preferably meets the channel 2 tangentially to the channel 2 at a merging point where channel 3 meets the channel 2. This is substantially the point "A" in FIG. 1.

Gates are provided such as gates 4 along with a pump 5 that feeds water into the reservoir to build a head of water higher than the channels standing water level. By releasing the gates 4 a wave or surge of water passes down the branch channel 3 into the main channel 2, The branch channel may be inclined downwards toward the channel to increase the force of the surge at point A. The intention is to build a wave of increasing size that travels intact around the channel, As the wave comes back to a selected point such as the point "A" a further wave is joined to the side of the first wave. This can be done quite precisely using a sensor that detects the first wave and allows the second wave to be joined substantially seamlessly. This can be achieved as the waves have a substantially precise speed. As the energy of the second wave merges with the energy of the first wave the combined energies build a bigger third wave and so on. Thus the wave height is incrementally increased which allows energy to be saved. It will be apparent that more than one wave forming means could be provided around the channels particularly where a longer channel is provided. Channel 2 may be at it's widest just beyond point A and may continue to narrow in a controlled manner such that prior to channel 2 converging with channel 3, channel 2 is at its narrowest. This helps sustain the wave height over one complete circuit and allows a more seamless blending of wave energy at point A.

Accordingly the wave, rather than being spent on a beach or other coastline, is able to be enlarged over time to the limiting wave height. Each new input wave continues to add sufficient energy to overcome losses plus desirably adds further energy to add height to the wave. It is believed that little energy is dissipated as the ever building wave circles the channel 2. There is some friction loss around the walls of the channel but this is relatively small. Waves are generated in a substantially controlled manner to minimise other more significant irrevocable losses which begin once the wave starts breaking. In principal it may be possible to recapture some of this lost energy by varying the depth of the canal. Deeper water following shallower water will recover the wave to some extent. The channel bottom may be provided with features or obstacles to create a varying depth as will be described further herein after.

Alternatively the channel floor can be banked side to side to provide shallower water on the inside of the channel curve and deeper water nearer the outer side of the curve allowing for the curvature radius of the channel to be reduced such that their is little or no loss of energy causing breaking, due to centrifugal force as the wave bends around the curve in the channel. The tighter the channel curvature the deeper the water nearest the outer curve and the greater the centrifugal forces which will act not only on the water itself but on the surfer. This will add to the excitement for the surfer.

Alternatively the channel may be narrowed and made deeper at the same time to increase the still water depth, to compress the wave making it momentarily higher as it passes through a canyon-like section of channel.

I believe it is possible to generate a wave up to from approximately O5 m up to approximately 4 m depending on the depth of still water. The wave has a clean, steep enough surfable face to substantially replicate the shape of an ocean wind generated surfable wave. I believe that about 60% to 75% of the longitudinal face length of the wave face will be clean. The outer most wave end may break on tighter radiused bends because of centrifugal force and the inner end will have a more benign face slope. The height of the wave will have an optimum ratio to the depth of water beneath it before it starts to break. The clean or unbroken wave height is limited by the depth of still water in the channel. This height can be sustained if necessary by the channel width being reduced or the channel depth varied side to side allowing for the effect of centrifugal forces. In this case the unbroken wave height will be more similar from the inner side of the channel to the outer side.

Of course the device is capable of generating several waves such that there can be two or more waves preceding around the channel at any one time.

I believe that a suitable length of channel could be from as little as say 50 meters up to about 5000 meters. The longer the track of the channel the more waves that can be provided at any one time and the more surfers potentially call ride. The average width of the channel 21 I believe, should not be less than 2.5 meters and could be up to about 25 meters wide also providing as options small up to quite large facilities.

Figure 2:
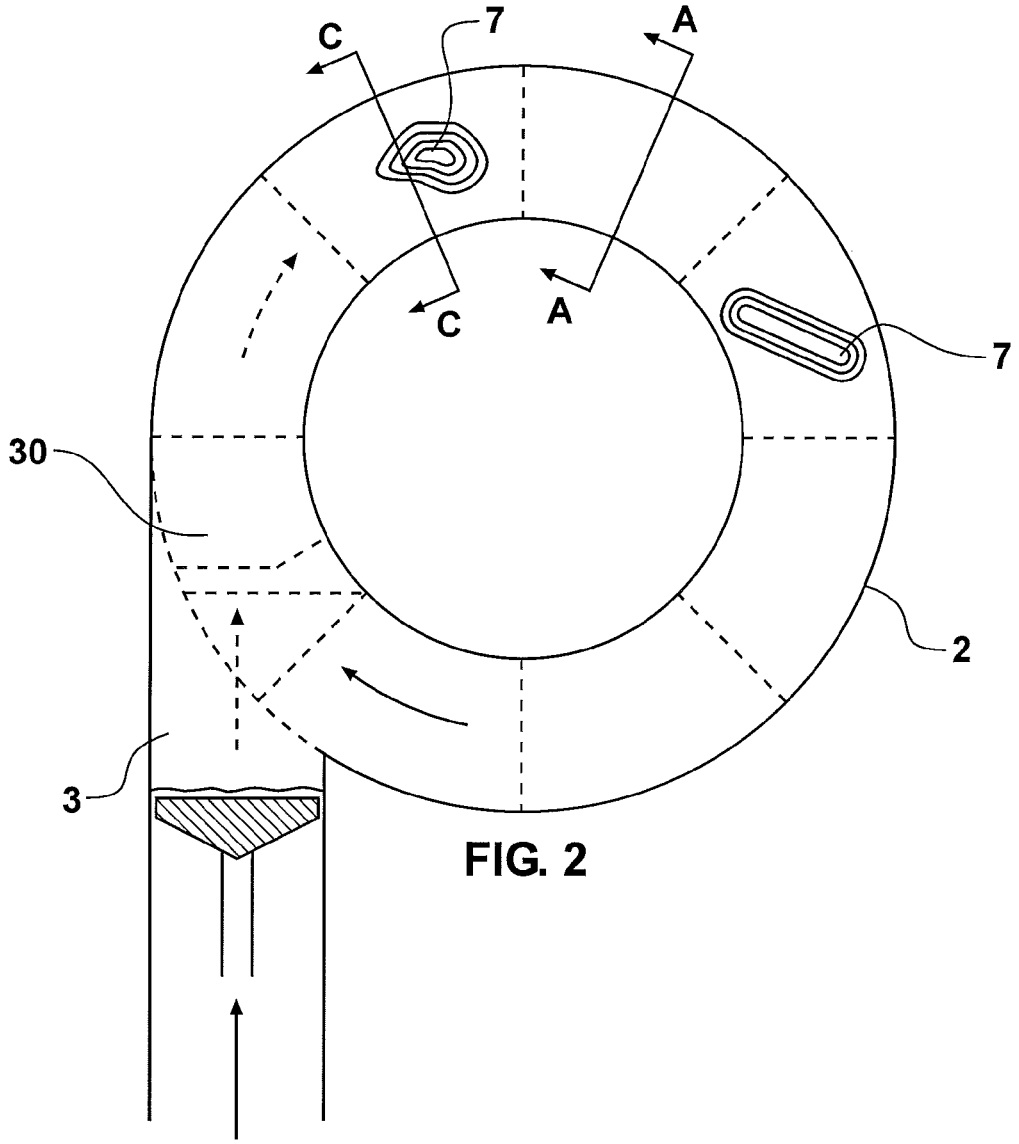
FIG. 2 is a plan view of an alternative ride according to a further preferred embodiment of the invention.
Figure 3:
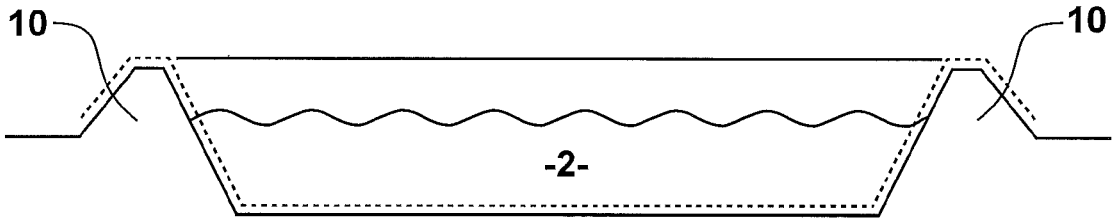
FIG. 3 is a cross section of "AA" in FIG. 2.

FIG. 2 illustrates diagrammatically a circular channel 2 with obstacles 7 positioned in the base of the channel.

The channel may be provided in any suitable manner and for example a substantially level channel can be dug with embankments 10 on each side. The channel would typically have a substantially level bottom end to end and side to side to provide an even standing water depth. The wave generated has a ratio of its height to the depth of water below it. The outer channel face takes the centrifugal force of the wave which is fairly steep say 1:4. The inner face is quite benign and could, for example, be a beach which surprisingly is not washed away by wave action. Beaches are represented at 15 in FIGS. 1 and 9. The beaches could be used as a safe entry or exit point for a surfer riding the wave in the channel. Although a wave call be bent around headlands and the like I believe that this is the first deliberate attempt to loop a wave back on itself capturing otherwise spent energy and providing a ride of long duration.

Figure 9:
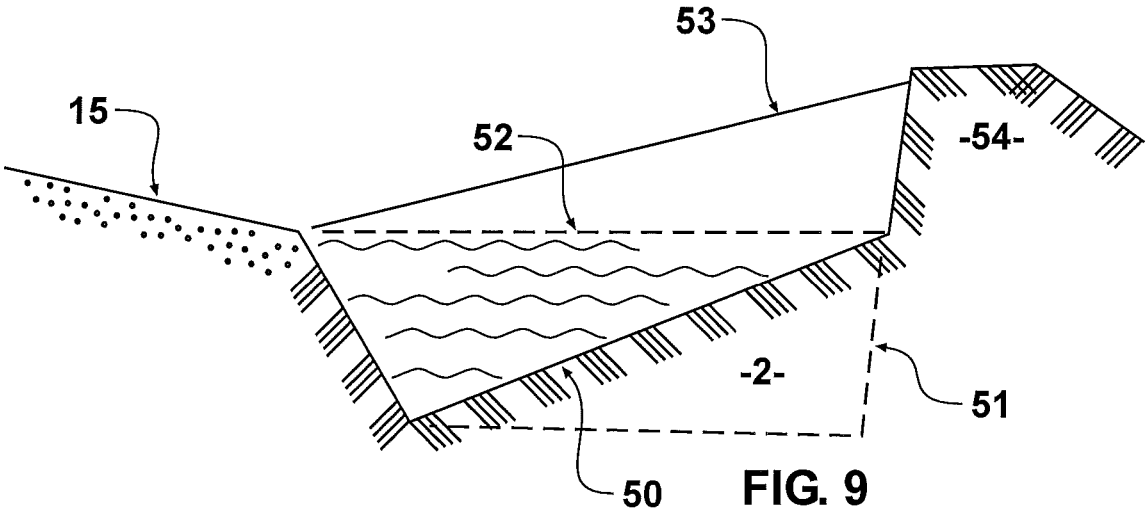
FIG. 9 is a transverse cross section through a banked curve forming part of a tide according to the invention.

FIG. 9 shows a beach 15 adjacent a banked curve 50 line 51 (peeked) shows the standard or normal channel profile, and line (pecked) 52 the water surface lever for still water, Water surfaces] builds up between the beach 15 and outer bank 54.

Figure 10:
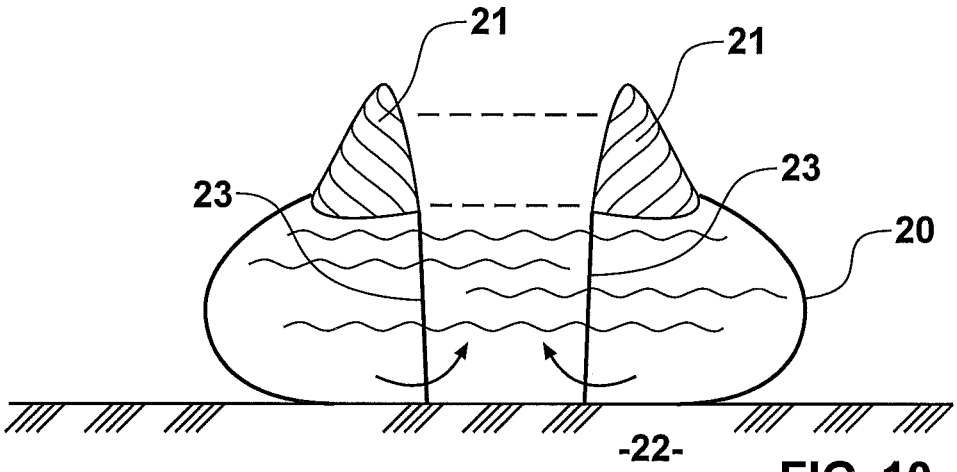
FIG. 10 is a transverse cross section through a channel forming part of a ride according to an alternative embodiment of the invention.
Figure 11:
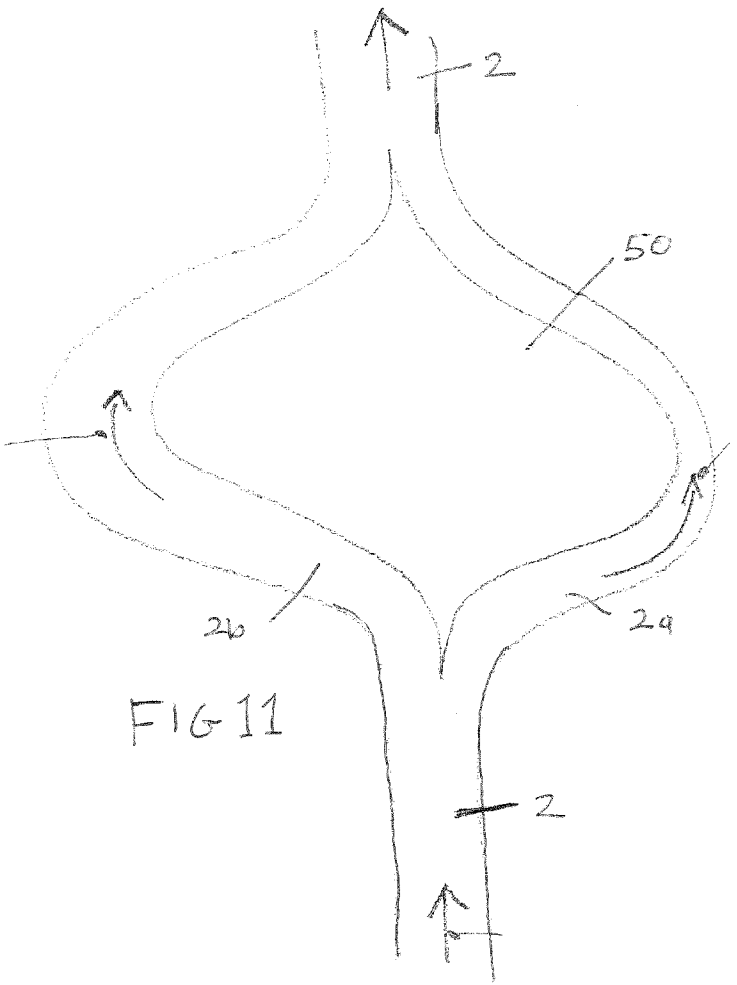
FIG. 11 shows an island in a channel of a preferred form of the invention.
Figure 12:
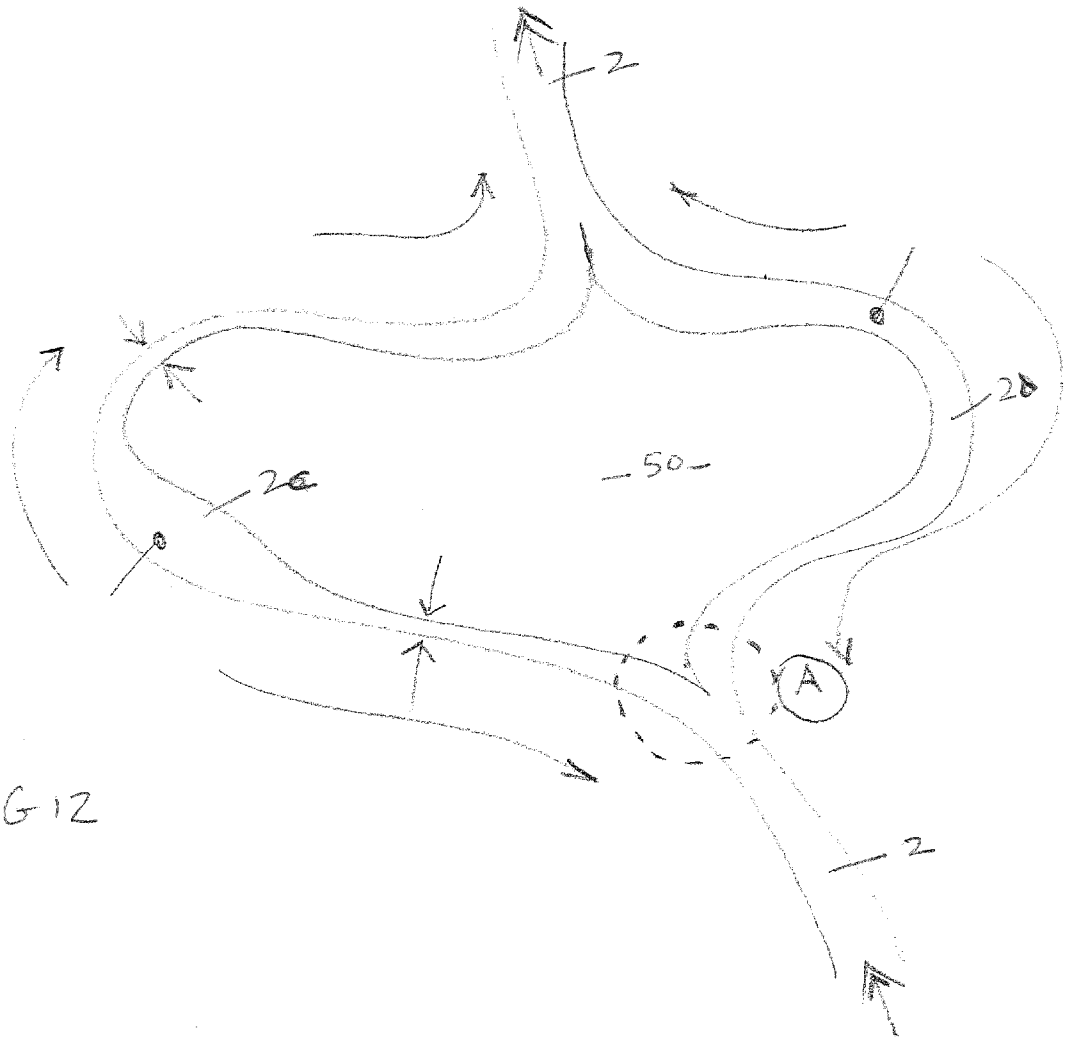
FIG. 12 is a view similar to FIG. 11 but showing the position of optional sections at "A"
Figure 13:
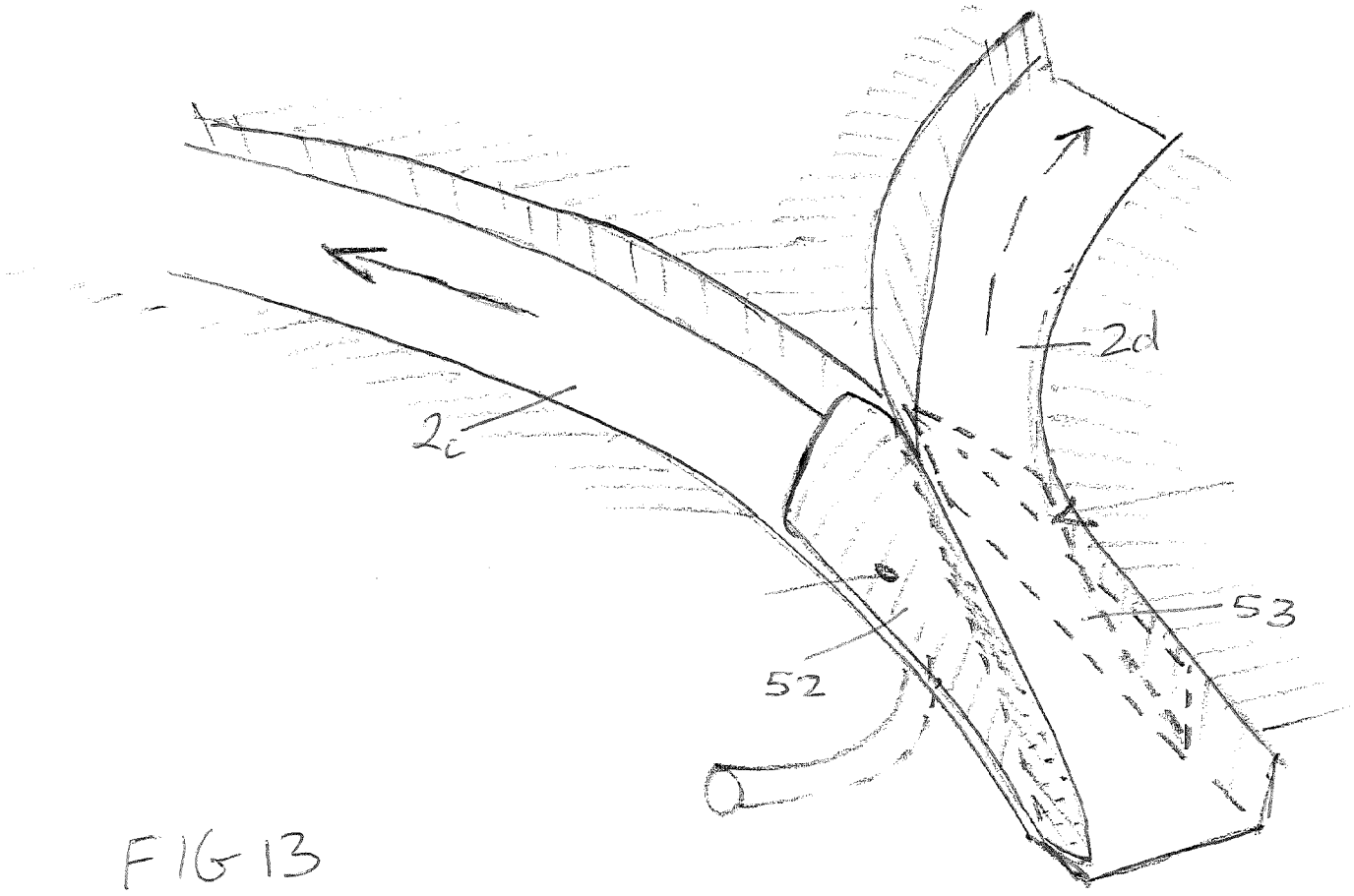
FIG. 13 shows the use of optional sections to close branch channels.

A second version is shown in FIG. 10 in which a pliable tough membrane, for example, the material used to build inflatable boats 20 can be provided with floating edge sections 21. The edge sections 21 could be permanently floating, for example, by being filled with styrene foamed blocks or other floating material or could be inflatable, for example, using compressed air, Such a construction would stand wholly on the ground 22 which would need to be fiat to maintain a constant water depth. As the channel is filled with water the edges of the pool would rise up, the edges being semi ridged in shape to stand firmly from the standing water level sufficient to contain a passing wave. Substantially vertical membranes 23 would be provided forming an up stand channel in the mid section. The membranes 23 would also restrain the floating edge sections 21 and moving wave. The outer two sides of the pool and cross section allow water to flow back to the device reservoir.

Figure 4:
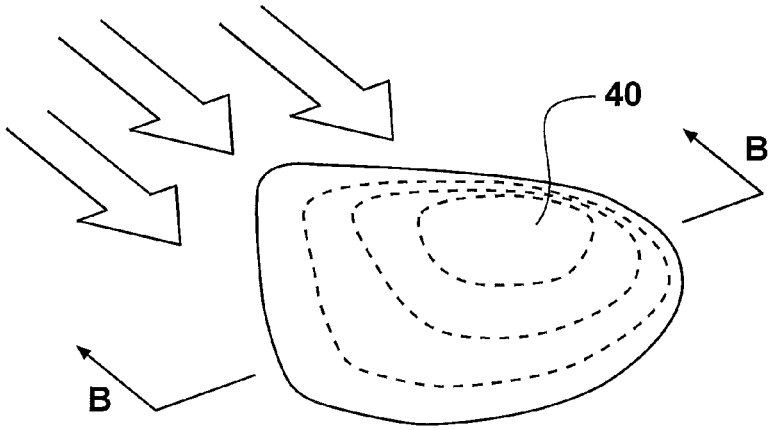
FIG. 4 is a diagrammatic representation of an obstacle usable in a ride according to the invention.
Figure 5:
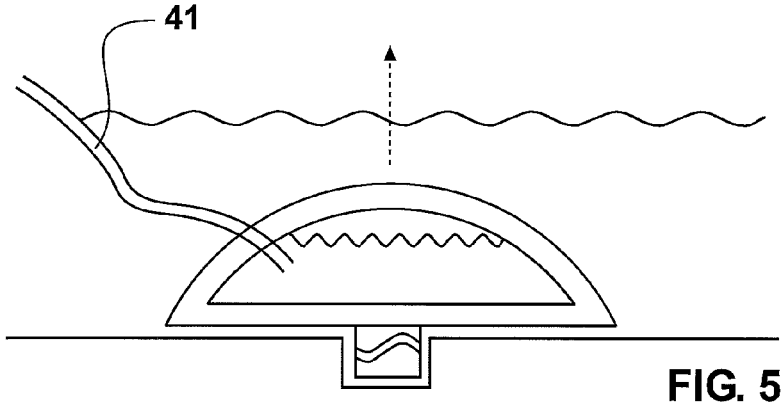
FIG. 5 is a cross section of "BB" in FIG. 4.
Figure 6:
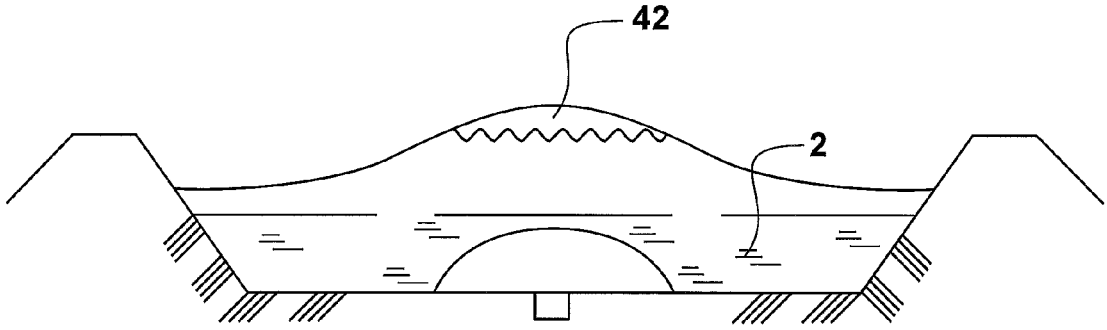
FIG. 6 is a cross section, for example, at "CC" in FIG. 2 but showing the obstacle therein.
Figure 7:
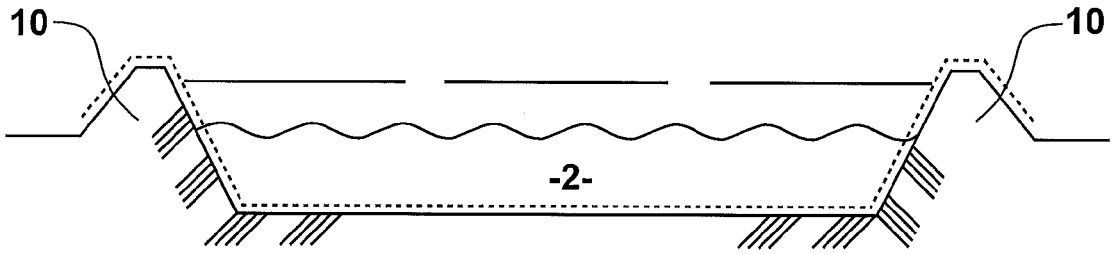
FIG. 7 is a further cross sectional view of a tide according to a preferred form of the invention.

FIGS. 4 to 6 show a possible feature or obstacle in the form of a mound 40 which could be hollow allowing the mound to be floated into position and sunk at a selected position in channel 2 before air is exhausted through line 41 when the mound is in position. The mound will cause the wave to crest 42 over the mound 40.

Figure 8:
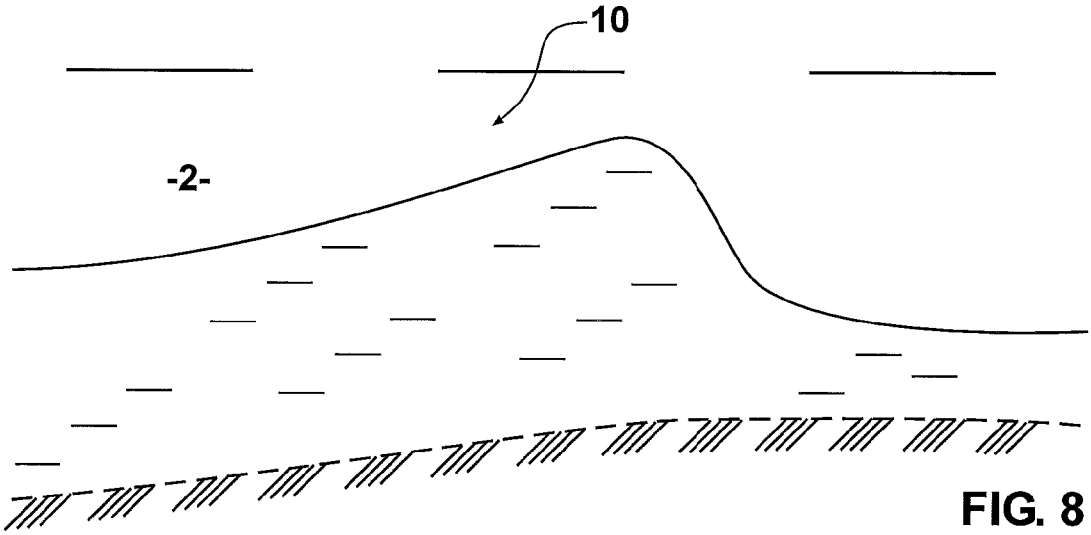
FIG. 8 is a longitudinal cross section through part of a ride according to a preferred form of the invention.

FIG. 8 shows an expected cross section through a wave in the channel 2.

Referring to FIGS. 1 and 2 the tangentially channel 3 leads to the merging section 30 so as to allow the second wave to readily blend with the first wave within the channel 2, The ratio between the wicks of the first wave and the second wave at point A should be between 4:1 down to 1:1. This ratio varies broadly speaking depending on energy input. The smaller the portion of the second wave the less energy and the longer time it takes to build the desirable surfable wave. The reservoir used by the pump at 5 draws water from the channel 2 preferably at various points around the channel 2 through outlets 35, for example, drawing through conduit 36. A vertical slated gate when opened dumps the water into the channel system as previously described. The water in the system could be seawater or fresh water and could provide opportunities, for example, for recreational or competitive surfing, kayaking, boogie boarding, body surfing and like pursuits. The construction could provide waves suitable for typical recreational surfers or for professional or competitive surfers.

The channel 2 may have an island 50 which separates the wave into two distinct parts moving along channel parts 2*a* and 2*b* allowing these two parts to join together as they pass beyond the island 50.

The channel 2 may include sections 2*c* and 2*d* that are temporarily blocked off to the main channel at each of their ends. These sections can be included in the main channel circuit by removing from each of their ends smooth barriers 52 and 53 which may then be used to block off the section of channel formerly in use. Barriers 52 and 53 may be inflatable so as to sit on the bottom of channel 2 until inflated. Barrier 52 is shown inflated and barrier 53 is shown pecked to indicate it is uninflated.

Thus it can be seen that a ride is provided which compared to a conventional artificial wave pool has running costs that are expected to be lower and the number of waves and therefore surf rides is higher. The construction does not need to be inside a building and is able to be used year round particularly where the climate is conclusive to all year surfing.

In one preferred option by providing only one surfer at a time per wave the construction has a high degree of safety.

Wave sizes can be varied depending on the overall size of the facility, such that the size of wave generated is not necessarily the maximum height dependent on the depth of still water. The still water level can be varied to alter the optimum unbroken height and front face of the wave as there is always a definite ratio between the depth of still water and the corresponding optimum wave generated whose face is at its steepest just prior to it breaking. This provides choice such that it would be possible to have separate days, for example, for women, children, professionals and learners. With no major building required the whole construction could be readily removed and the land reinstated if necessary.

Other environmental benefits could include less travel costs to distant beaches and the ride could be centrally located perhaps on leased public land. If located near the sea it could double as an aquarium.

Throughout the description and claims of this specification the word comprise and variations of that word, such as "comprises" and "comprising," are not intended to exclude other additives, components, integers or steps.

I claim:

1. An apparatus for creating variable rideable waves, comprising: a main channel forming a closed loop, the main channel containing water and having a varying width; a branch channel intersecting the main channel at a point of convergence between the main channel and the branch channel; and a reservoir configured to release water into the main channel by releasing water through the branch channel to the main channel, the released water creating at least one wave that circumnavigates the closed loop without breaking, wherein the main channel narrows in width approaching the point of convergence between the main channel and the branch channel in order to sustain a height of the at least one wave about the closed loop, and the reservoir is configured to selectively increase the at least one wave in size by releasing the water into the main channel through the branch channel as the at least one wave passes the narrowed width of the main channel and approaches the point of convergence; wherein the main channel narrows in width in an area of the main channel immediately prior to the point of convergence between the main channel and the branch channel; wherein a narrowest width of the main channel is at the area of the main channel immediately prior to the point of convergence; and a sensor configured to detect the at least one wave in the main channel, wherein the water is released into the main channel from the reservoir to increase the size of the at least one wave in response to the sensor detecting the at least one wave in the main channel.

2. The apparatus for creating variable rideable waves as claimed in claim 1, wherein the closed loop is free of any of a beach or artificial coast line at any point on the outside of the loop.

3. The apparatus for creating variable rideable waves as claimed in claim 1, wherein the main channel has a widest width immediately after the point of convergence between the main channel and the branch channel.

4. The apparatus for creating variable rideable waves as claimed in claim 3, wherein the main channel begins to narrow from the widest width about the closed loop until the point of convergence.

* * * * *